US007814898B2

(12) United States Patent
Rumbaugh

(10) Patent No.: US 7,814,898 B2
(45) Date of Patent: Oct. 19, 2010

(54) HIGH CAPACITY SNOW MELTING APPARATUS AND METHOD

(75) Inventor: Kenneth F. Rumbaugh, Middleburg Heights, OH (US)

(73) Assignee: Snow Dragon LLC, Cleveland, OH (US)

( * ) Notice: Subject to any disclaimer, the term of this patent is extended or adjusted under 35 U.S.C. 154(b) by 1295 days.

(21) Appl. No.: 11/199,187

(22) Filed: Aug. 8, 2005

(65) Prior Publication Data

US 2007/0029402 A1 Feb. 8, 2007

(51) Int. Cl.
*E01H 5/10* (2006.01)

(52) U.S. Cl. ..... 126/343.5 R; 126/271.1; 165/179; 37/227; 37/228

(58) Field of Classification Search ..... 126/343.5 R, 126/271.1; 165/179; 37/227, 228
See application file for complete search history.

(56) References Cited

U.S. PATENT DOCUMENTS

| | | | | | |
|---|---|---|---|---|---|
| 557,163 | A | * | 3/1896 | Springfels | 126/343.5 R |
| 950,413 | A | * | 2/1910 | Stedman et al. | 126/343.5 R |
| 1,204,400 | A | * | 11/1916 | Brauninger | 126/343.5 R |
| 1,339,719 | A | * | 5/1920 | Savonius | 126/343.5 R |
| 1,349,853 | A | * | 8/1920 | Peden | 126/343.5 R |
| 1,352,567 | A | * | 9/1920 | Wettervik | 37/224 |
| 1,418,630 | A | * | 6/1922 | Crouse | 126/343.5 R |
| 2,465,953 | A | * | 3/1949 | Wollner | 126/343.5 R |
| 2,471,733 | A | * | 5/1949 | Fiduccia | 126/343.5 R |
| 2,592,267 | A | | 4/1952 | Gangemi | |
| 2,779,856 | A | * | 1/1957 | Fahner | 392/382 |
| 3,052,231 | A | | 9/1962 | West | |
| 3,098,478 | A | | 7/1963 | Philbrook | |
| 3,140,708 | A | * | 7/1964 | Petlak et al. | 126/343.5 R |
| 3,270,741 | A | * | 9/1966 | Petlak | 126/343.5 R |
| 3,373,734 | A | | 3/1968 | Roemer | |
| 3,381,680 | A | * | 5/1968 | Retz | 126/343.5 R |
| 3,577,975 | A | * | 5/1971 | Farsbetter | 126/343.5 R |
| 3,847,137 | A | | 11/1974 | Lambertoni | |
| 3,981,296 | A | * | 9/1976 | Medina | 126/343.5 R |
| 4,288,931 | A | | 9/1981 | Rhodes | |
| 4,324,307 | A | * | 4/1982 | Schittino et al. | 180/313 |
| 4,418,682 | A | | 12/1983 | Heller | |

(Continued)

FOREIGN PATENT DOCUMENTS

JP 03-43511 2/1991

(Continued)

*Primary Examiner*—Kenneth B Rinehart
*Assistant Examiner*—Jorge Pereiro
(74) *Attorney, Agent, or Firm*—James C. Scott; Roetzel & Andress

(57) ABSTRACT

A high capacity snow melting apparatus has a hopper with one or a plurality of dedicated heater/blower units coupled to a plurality of commingled heat radiant conduits for contact with snow, ice and water, and manifolds connected to the conduits for additional heat exchange and to direct heated air onto snow in the hopper. Terminal sections of the conduits are elevated to an upper region of the hopper and have downwardly directed exhaust ports for substantial and efficient preheating of new snow loads. Heat exchanger passages through the heated air conduits allow water to flow in the path of heated air in the conduits to substantially increase snow and ice melting efficiency of the conduits. A water bath in the bottom of the hopper is level controlled to cover the conduits and drain water from the hopper.

32 Claims, 7 Drawing Sheets

U.S. PATENT DOCUMENTS 4,494,567 A * 1/1985 Troyen ..... 137/561 A
4,785,561 A 11/1988 Swanson
4,854,381 A * 8/1989 Mikula ..... 165/158
5,199,198 A * 4/1993 Godbout ..... 37/196
5,235,762 A * 8/1993 Brady ..... 37/228
5,266,220 A * 11/1993 Hammond et al. ..... 210/768
5,435,627 A * 7/1995 Fleming ..... 298/17 R
5,588,231 A * 12/1996 Mavrianos ..... 37/227
5,787,613 A * 8/1998 Derome ..... 37/228
6,068,200 A * 5/2000 Kime ..... 239/7
6,360,738 B1 * 3/2002 Brooks ..... 126/343.5 R
6,736,129 B1 * 5/2004 Smith ..... 126/343.5 R
6,959,145 B1 * 10/2005 Narvaez ..... 392/382
6,971,596 B2 12/2005 Monroe

FOREIGN PATENT DOCUMENTS

JP 09209324 A * 8/1997
JP 10216566 A * 8/1998
JP 10266154 A * 10/1998

* cited by examiner

HIGH CAPACITY SNOW MELTING APPARATUS AND METHOD

FIELD OF THE INVENTION

The present invention pertains generally to large size snow management equipment and methods and, more particularly, to snow melting equipment.

BACKGROUND OF THE INVENTION

Among the methods and machines used for snow removal and management of snowfall, various approaches have been taking to melting snow, including permanently installed surface heating systems, mobile devices for direct application of heat to snow layers and heated pits or bins configured to receive snow in bulk as from a front-end loader or plow. Most such devices rely on hot air or water as the primary heat source to melt the snow, or a combination of both.

In one type of hot air melter, one or more sources of hot air are ducted to a network of pipes positioned at or near the bottom of a snow-receiving hopper, melting the snow on contact, with the bottom of the hopper appropriately plumbed for drainage. In hot water type melters, hot water pipes are located at or near the bottom of the hopper, and in some cases submerged in a water bath as a heat exchanger. Snow comes in contact with the water bath through a protective grate. In some devices the water of the water bath is agitated to promote uniform heat distribution and thermal efficiency in the melting process. Hot gases from heat exchangers are also vented into the snow melting chamber. In some heat exchanger type melters, the melted snow is recirculated for continuous water supply. In another device snow is loaded into a water filled pit or melting tank which incorporates a burner system. The burner fires downward through a tube which is immersed in the water. Heated combustion products from the burner are mixed with the water and travel up through a weir tube together. Cooled gases escape to the atmosphere and warm water is sprayed over the snow to promote further melting.

SUMMARY OF THE INVENTION

The present invention provides an improved snow melting apparatus and method in which a large capacity hopper is fitted with a plurality of heating conduits, each connected to a hot air source and preferably each to a separate hot air source. The conduits are commingled and have substantially horizontally disposed sections which run in parallel or other arrangements substantially across a bottom region of the hopper to form a high energy thermal zone for direct contact by snow and ice. Each conduit further has a generally vertical section which extends from a distal end of the horizontal section upward from a lower region of the hopper along and inside a side wall of the hopper and terminates in a downdraft outlet or nozzle directed at an upper region of the hopper. The conduits are further in an opposed arrangement in the hopper, with a heat source or sources located at each end of the hopper, and the vertical sections and downdraft outlets located at each end of the hopper. The coverage and thermal radiance of the conduits extends over substantially all of the bottom region of the hopper and both end walls of the hopper in combination with the downdraft outlets in the upper region provides a high capacity snow melting apparatus with high thermal and energy efficiency. An open protective grate overlies at least a portion of the horizontally disposed sections of the conduits.

A resulting water bath 52 in the bottom of the hopper is hydrodynamically maintained above or below the grate by drainage control.

The invention further provides a snow melting apparatus with a hopper for receiving a quantity of snow or ice to be melted, the hopper having a bottom and four side walls, an opening defined by tops of the four side walls and a protective grate at least partially covering the opening of the hopper, a plurality of heater/blower units, each heater/blower unit operatively connected to a conduit which extends through one of the walls of the hopper, each conduit having a section which runs proximate to the bottom of the hopper, and a section which extends upward from the bottom of the hopper proximate to a side wall of the hopper and terminating in an exhaust which is directed downward into the hopper and located under the protective grate.

These and other aspects of the invention are further described herein in particular detail with reference to the accompanying drawing Figures.

DETAILED DESCRIPTION OF PREFERRED AND ALTERNATE EMBODIMENTS

Figure 1:
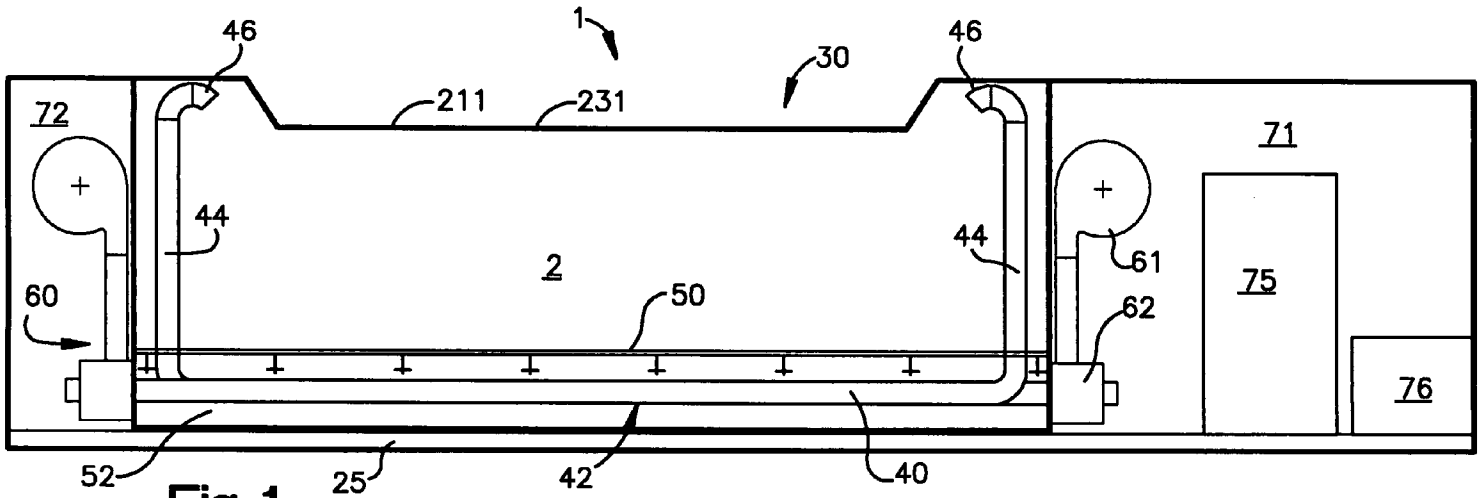
FIG. 1 is an elevation of a snow melting apparatus constructed in accordance with the design principles of the present invention.
Figure 2:
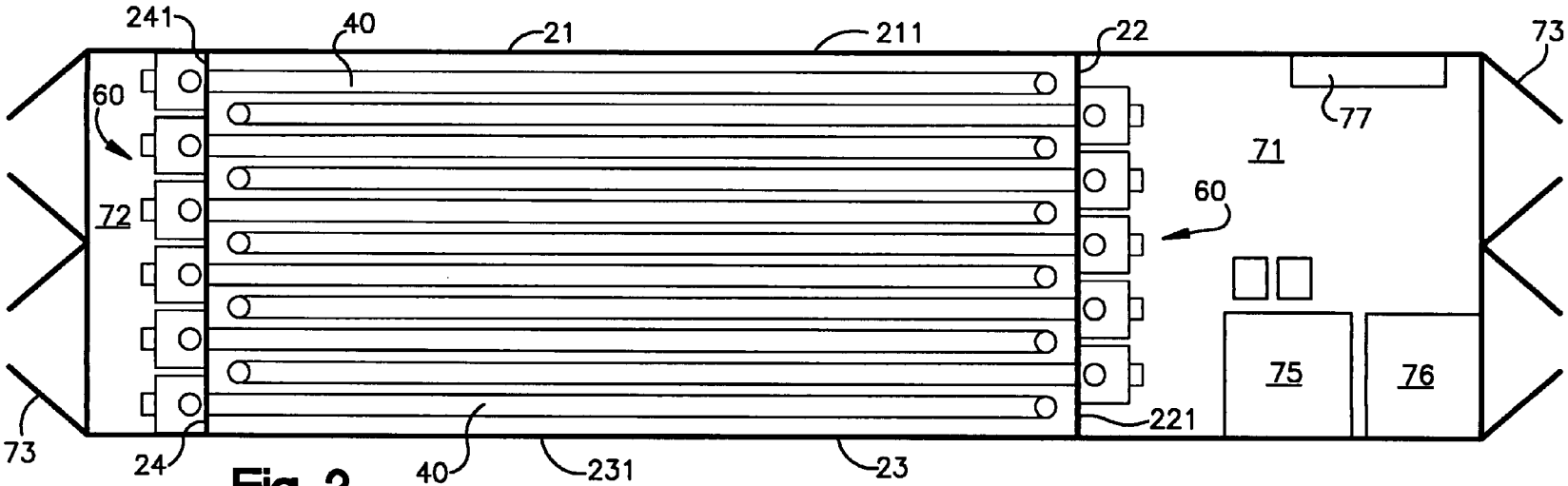
FIG. 2 is a top view of the snow melting apparatus of FIG. 1.

With reference to the Figures, there is shown a snow melting apparatus, indicated generally at 1, which includes a hopper, indicated generally at 2, which in the form shown is a generally rectangular vessel with adjoined walls 21, 22, 23 and 24 and a bottom 25 defining an internal cavity 30 configured to receive material, such as snow and ice, in bulk quantities. Although the invention is not limited to by any particular dimensions, relative dimensions or ranges of dimensions, a representative size of a commercial application snow melting apparatus 1 for high volume, high capacity operations as in major cities and at large airports might be an internal cavity 30 in a size range of approximately 5000 to 10,000 cubic feet. One set of representative dimensions is side walls 21, 23 thirty (30) feet in length, opposing end walls 22 and 24 twelve (12) feet in length; the respective tops 211, 221, 231 and 241 of the four walls 21, 22, 23 and 24 terminating in approximately the same plane at, for example, twelve (12) to fourteen (14) feet above the bottom 25, or any other suitable height dimension. As shown in FIG. 1, the tops 211 and 231 of side walls 21 and 23 can be notched lower in a central section for additional clearance for any type of loading or transfer of snow into the internal cavity 30. The bottom 25 covers the expanse of the internal cavity 30 and may extend beyond any of the four walls 21, 22, 23 or 24 for mounting of additional equipment as further described. Collectively, the structure of the four walls 21, 22, 23 and 24 and bottom 25 which define the internal cavity 30 is alternatively and generally referred to herein as a "hopper" for receiving snow and ice to be melted. The walls 21, 22, 23 and 24 and bottom 25 may be constructed with appropriate structural and insulating layers of the materials for both load capacity, thermal efficiency and substantially water tight operation, all as further described.

Within the internal cavity 30 are mounted a plurality of conduits 40, also referred to as conduit assemblies, preferably in the form of steel pipe, such as Schedule Forty steel pipe of any suitable diameter but preferably in a range of 4 inches to 10 inches O.D. or greater. Each conduit 40 has a generally horizontal segment or section 42 which runs over the expanse of the bottom 25 within the internal cavity 30, and as shown preferably running a substantial length of the internal cavity 30 between end walls 22 and 24. The conduits 40 can be commingled in any suitable arrangement, including run in parallel as shown, or otherwise nested or matrixed together to substantially cover the expanse of the bottom 25 to provide a high thermal energy plane for direct contact with snow and ice. Also, any segments of the conduits, including segments 42, can have varying size or diameter as shown to increase the amount of heated surface area for contact with snow and ice. An open protective grate 50 covers the horizontal segments 42 of the conduits 40. Each conduit 40 further has a vertical segment 44 which extends upward from a distal end of horizontal section 42 proximate to the interior of end walls 22 and 24 and through the grate 50 and terminating in a downdraft exhaust 46 oriented toward an upper region of the internal cavity 30, and preferably within the walls 21, 22, 23 and 24. The downdraft exhausts 46, also referred to as exhaust ports, of the conduits 40 collectively create a substantial heated air mass in the upper region of the hopper 2 which immediately acts upon freshly loaded snow to melt or otherwise raise the ambient temperature of the load prior to reaching the water bath 52 and horizontal sections 42 of the conduits 40. An upper protective grate 55 is attached to the top ends of the hopper walls at the ends to cover the vertical segments 44 and downdraft exhausts 46 so that they are not contacted by snow as it is loaded into the hopper.

Figure 3:
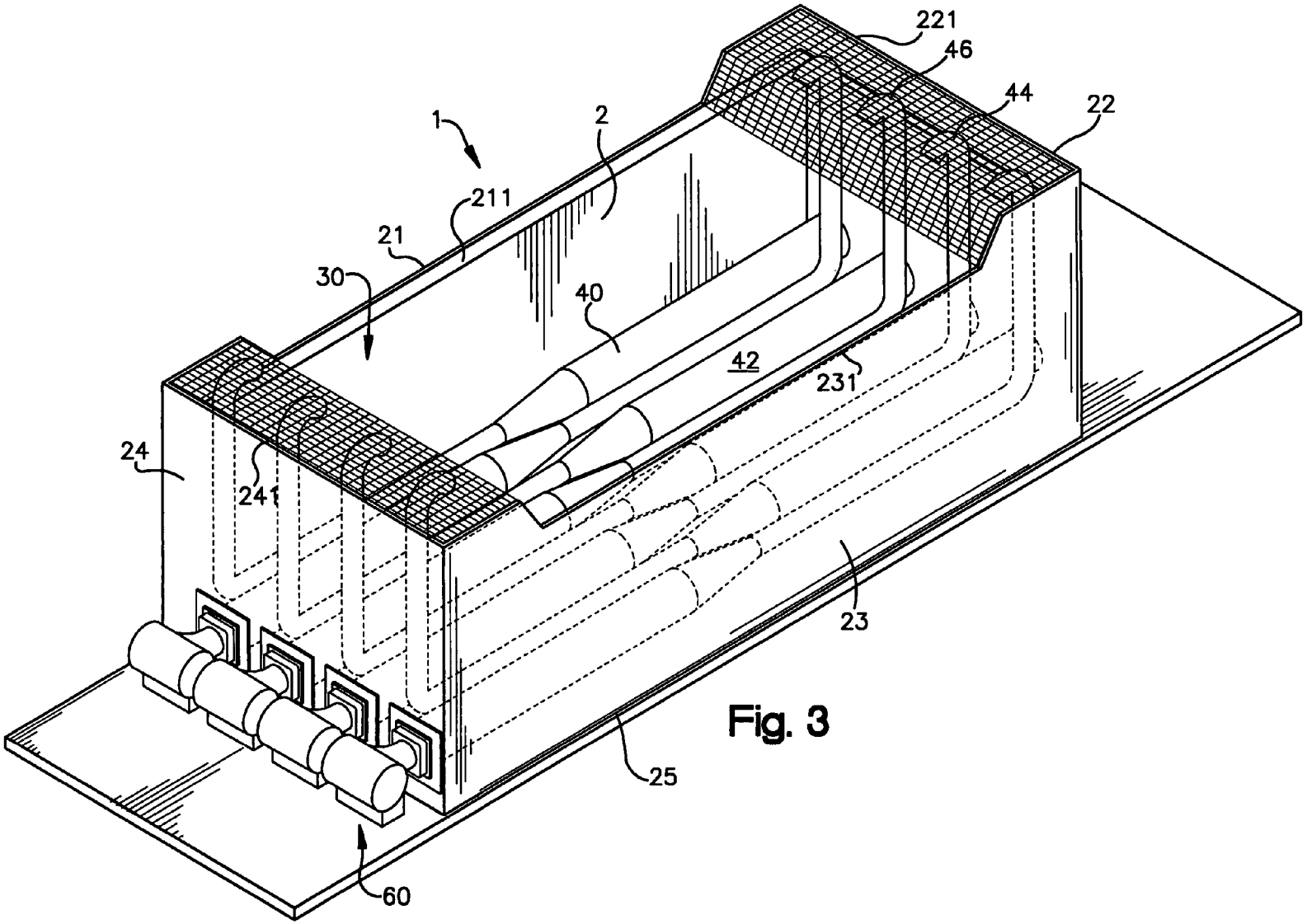
FIG. 3 is a perspective view of an alternate embodiment of a snow melting apparatus of the invention.

Each conduit 40 is preferably coupled through a respective end wall 22, 24 to a separate dedicated heat and forced air source, such as for example a heater/blower unit as indicated at 60. The heater/blower units 60 are preferably oil burners with an integrated blower, such as are commercially available, and can be conglomerated and arranged in groups for generation of ample BTUs relative to the volume of the internal cavity 30. Preferably, the heater/blower units 60 will cumulatively generate in a range of 9 to 80 million BTUs per hour. Each heater/blower unit 60 is separately ducted through the respective end wall 22, 24 for direct flow connection to a respective conduit assembly 40. As shown in FIG. 1, the blower 61 of the heater/blower unit 60 may be mounted above the heater unit 62, or alternatively integrated together as may be depending upon the model employed. The number of heater/blower units 60 may vary depending upon the size of the hopper and other design factors, as shown for example by the embodiment depicted in FIG. 3, having a total of eight heater/blower units, four located proximate to each end wall of the hopper. Also contemplated by the invention is the use of fewer heater/blower units ducted to multiple conduits or conduit assemblies, or a single forced air supply ducted to multiple heater units. A single heat and forced air supply source for each conduit assembly 40 achieves very high BTU output per conduit for optimized melting efficiency. For example, depending upon the designed BTU output of each heater/blower unit 60, a source temperature may generate a temperature in the conduit 40 in a range of 1000 to 1200 degrees F., and an exhaust temperature at the exhaust 46 in an approximate range of 300 to 600 degrees F., and an average temperature in the horizontal sections 42 of the conduits 40 in the water bath 52 in a range of 200-300 degrees F.

The heater/blower units 60 are preferably housed within extensions of the walls 21, 22, 23, 24 and bottom 25 proximate to the hopper 2, forming enclosures 71 and 72, for example at opposite ends of the hopper 2. Each enclosure 71, 72 is provided with access panels or doors 73. Enclosure 71 can be dimensioned to house additional accessory equipment such as one or fuel supply tanks 75 with fuel connections (not shown) to each heater/blower unit 60; auxiliary electrical supply 76 such as generator and/or DC battery bank, and an electrical power control panel 77 including switches, relays and breakers for controlling electrical supply collectively and separately to the heater/blower units 60 and any other electrical accessories such as lighting, sensors of any type, alarms, and water valve controls for control of drainage valves 80 in one or more of the walls 21, 22, 23 or 24 or through bottom 25 to control the depth of the water bath 52 within the hopper and with respect to the grate 50 for optimal thermal efficiency.

Figure 4A:
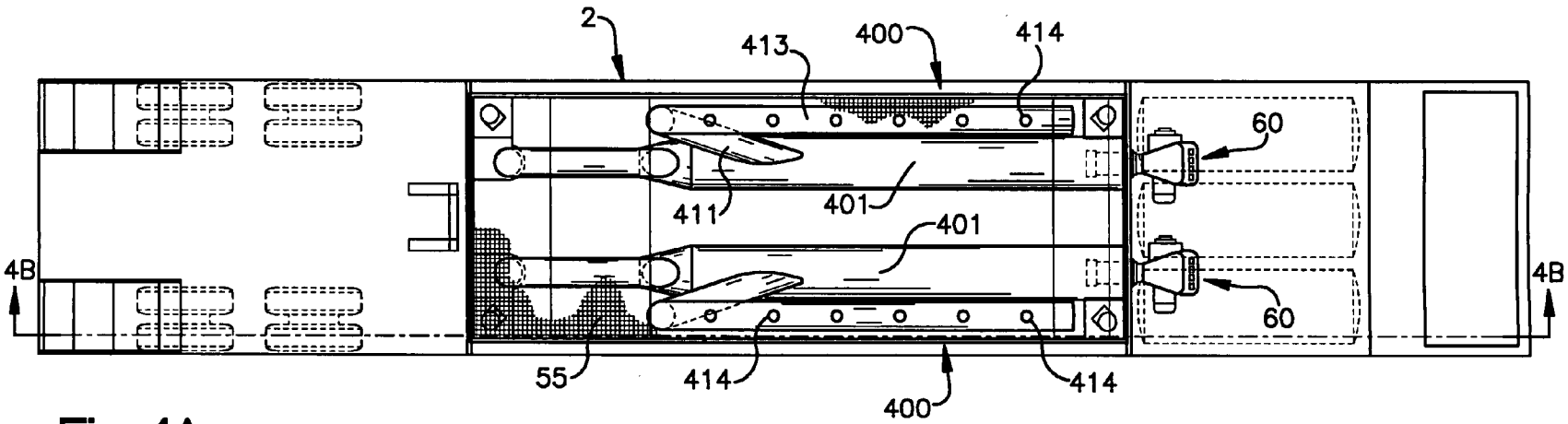
FIGS. 4A, 4B and 4C are top, side and end views respectively of an alternate embodiment of a snow melting apparatus of the invention.
Figure 4B:
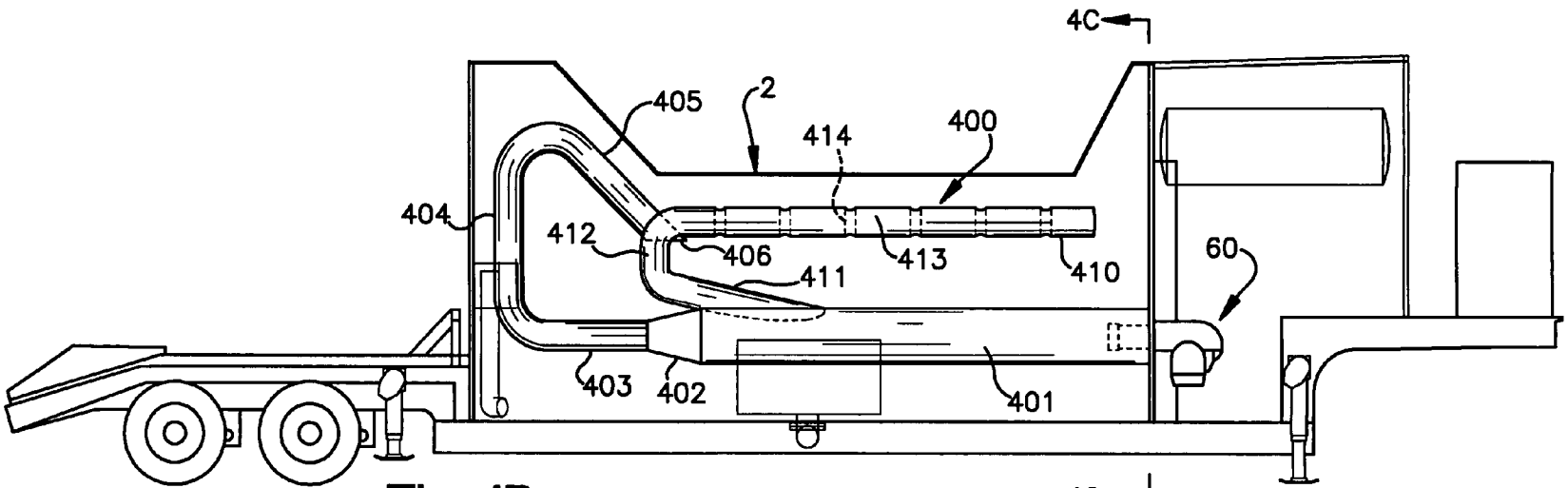

FIGS. 4A and 4B illustrate an alternate embodiment of the invention wherein a hopper 2 is equipped with heater/blowers 60 connected to conduit assemblies 400. Although shown equipped with two heater/blowers 60, each operatively connected to a corresponding conduit assembly 400, the invention can be practiced by use of only a single heater/blower or other source of forced and heated air in combination with only a single conduit assembly, or more than two heater/blowers 60 with associated conduit assemblies 400. The conduit assemblies 400 each have a primary intake conduit section 401 which has a relatively larger diameter or cross section to optimize air flow and heat transfer across the conduit wall to snow in the hopper. The larger sized intake section 401 runs a substantial length of the hopper 2 proximate to bottom 25, but can be of any length or configuration. The primary intake section 401 leads, through a taper 402, to a relatively smaller section 403, a vertical section 404 and a downdraft section 405 with exhaust port 406. The downdraft section 405 and exhaust port 406 are preferably located within an upper region of the hopper in order to direct heated air downward onto the snow and ice contents of the hopper 2. As used herein, the terms "operatively connected" and "connected" as used with reference to the various described and claimed conduit assemblies defines the connections of conduits and tubular sections to form a continuous or discontinuous air passageway from a heater/blower unit and through and into the hopper 2.

Also extending from the intake section 401 is a manifold 410 which has a diverter section 411, a return 412, and a main section 413 which runs along a length of the hopper 2, and is preferably located in an upper region of the hopper and above the corresponding primary intake conduit 401. As shown in FIG. 4A, the manifold 410 can also be located laterally outboard of the corresponding primary intake conduit 401, and supported by attachment to the interior of the adjacent wall of the hopper or by any other suitable mechanical support or attachment. Multiple heat exchanger passages 414 are provided along the length of the main section 413. The heat exchanger passages 414 are in one form pipes or fluid conduits which allow water to flow through a substantial cross-section of the main section 413 in the flow of heated air in the main section 413 which thus heats water present in the heat exchanger passages 414. The heat exchanger passages 414 substantially increase the melting efficiency of the apparatus 1. Additional heat exchanger passages 414 can be provided in any size or orientation in any of the various sections of the conduit assemblies 400 which may be completely or partially submerged at any time during operation. As used herein, the term "heat exchanger passages" refers to any water passageway or cavity which is in a conduit of the conduit assembly or otherwise in a flow or stream of heated air from a heater/blower unit or other source of heated forced air. In one particular embodiment, heat exchanger passages 414 are in the form of pipes with ends mounted in the walls of the manifold 410 to extend through a cross-section of any section of the manifold. The heat exchanger passages 414 can be of any size or configuration which allows flow or filling of water therein. Other or additional manifolds can be similarly configured and positioned within the hopper and directed or shunted from the primary intake conduit or connected directly to the same or separate forced hot air sources. As in the other embodiments, an upper protective grate 55 is attached to the top ends of the hopper walls at the ends to cover the vertical segments 44 and downdraft exhausts 46 so that they are not contacted by snow as it is loaded into the hopper.

Figure 4C:
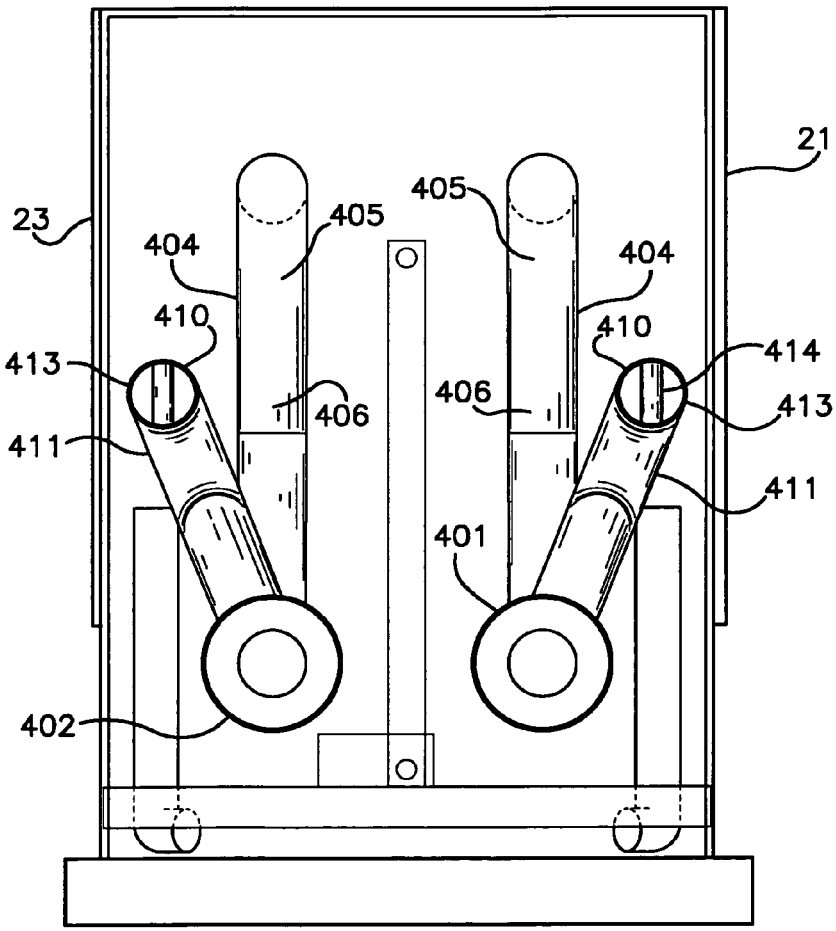

In use and operation, the snow melter apparatus 1 can be transported to and set up at any suitable location, by for example trailer or rail car or in component parts for assembly on site. The apparatus 1 is shown in FIGS. 4A-4C mounted on a flatbed or lowboy type road trailer 100 positioned upon the trailer bed 101 with the hopper generally aligned with the length of the trailer. When mounted on a lowboy type trailer as shown, the overall height of the apparatus 1 and the top edge of side walls 22, 24 is reduced to facilitate loading of the hopper by front-end loader. The apparatus can thus be positioned for access to drainage infrastructure, or hoses can be connected to the water bath drains. The water bath can be primed with a small pre-load and the burners ignited and blowers activated. Operational temperatures of the heat source, conduits and ambient temperature in the hopper can be monitored for minimums to commence continuous melting at full capacity and rate, at which point loads are delivered into the hopper by loaders, conveyors or any other suitable material handling system adaptable for movement of snow and ice.

Figure 5A:
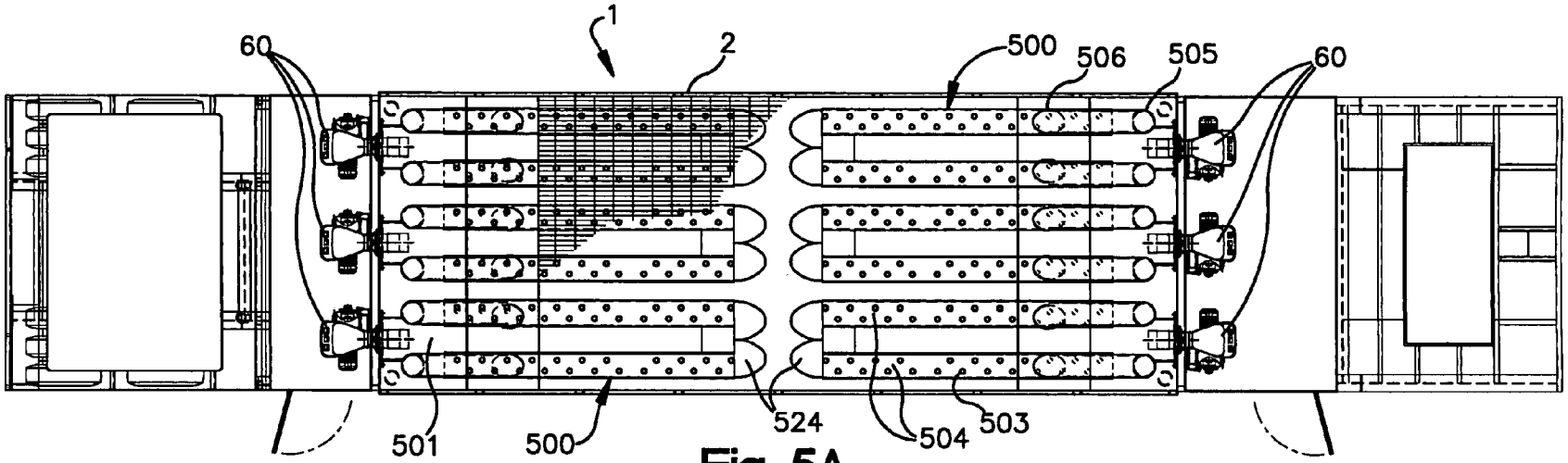
FIGS. 5A and 5B are plan and elevation view respectively of an alternate embodiment of a snow melting apparatus of the invention.
Figure 5B:
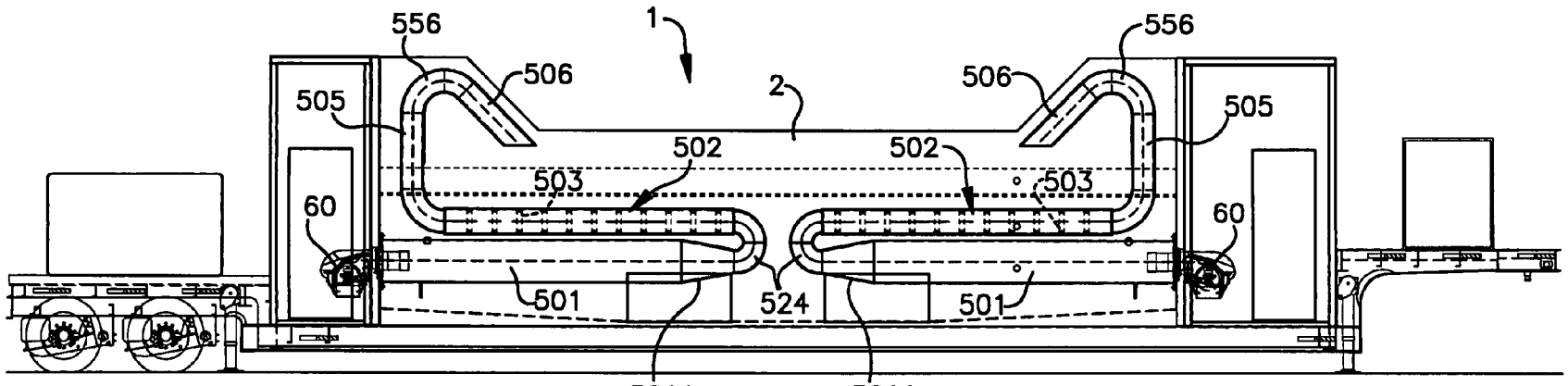

FIGS. 5A and 5B illustrate an alternate embodiment of snow melting apparatus 1 of the invention which has as many as six or more heater/blower units 60, each of which is connected to a conduit assembly 500 positioned within a hopper 2 as previously described. The conduit assemblies 500 each have a primary intake section 501 which is connected to a heater/blower unit and runs a substantial length of the hopper proximate to the hopper bottom 25, but which can be of any length or configuration. The volume or cross-sectional size of the primary intake section 501 can be made larger than other sections of the conduit assembly 500 to handle the air flow directly from the associated heater/blower 60, and to maximize thermal transfer near the bottom of the hopper 2 wherein the primary intake section 501 is preferably located. Each primary intake section 501 is connected to a multiple or double manifold 502, for example by a return section 524. The double manifold 502 has two conduits 504, for example in the form of generally linear sections of open pipe, which are generally aligned with or parallel to the corresponding primary intake section 501. In this embodiment each of the return sections 524 has a single open end which is coupled to a tapered end 5011 of the primary intake section 501, and splits to two opposite ends each of which are coupled to an end of a conduit 504. Each linear section of conduit 504 is connected at an opposite end to an upwardly extending or vertical section 505. An upper end of the vertical section 505 is connected, for example through a turn section 556, to a downwardly extending exhaust stack or port 506, the flow of which is directed into the interior of the hopper 2. The double manifold 502 of the conduit assemblies 500 thus effectively divides and distributes the heated air flow from each of the heater/blower units 60 for increased thermal transfer within the hopper 2 and greater distribution of heated exhaust air directed into the hopper 2 and snow and ice contained therein. Heat exchanger passages 503, the same or similar to the previously described heat exchanger passages 414, can be provided in the double manifold 502, for example in the linear sections 504, to allow for heat exchange, i.e. heating, of water which fills the heat exchanger passages 503 with heated air in manifolds 502 to substantially increase the melting efficiency of the apparatus. Although this particular embodiment refers to a double manifold 502, other manifold arrangements which extend from the primary intake section 501 are within the scope of the invention, including two or more linear or non-linear sections which extend from the primary intake 501 and with corresponding exhaust stacks or ports and heat exchange passages. With any particular blower and manifold configuration, the hopper 2 can be dimensioned comparable to the other embodiments and with the same operative components such as the burner rooms and control room, water bath and water drainage system, and trailer mounting.

Figure 6A:
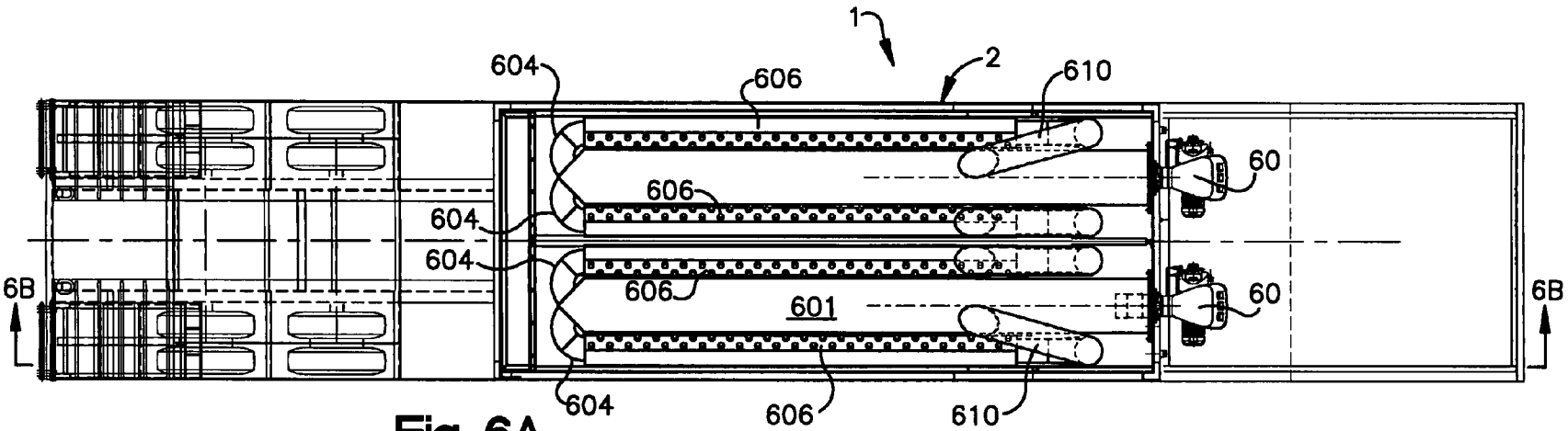
FIGS. 6A, 6B and 6C are top, side and end views respectively of an alternate embodiment of a snow melting apparatus of the invention.
Figure 6B:
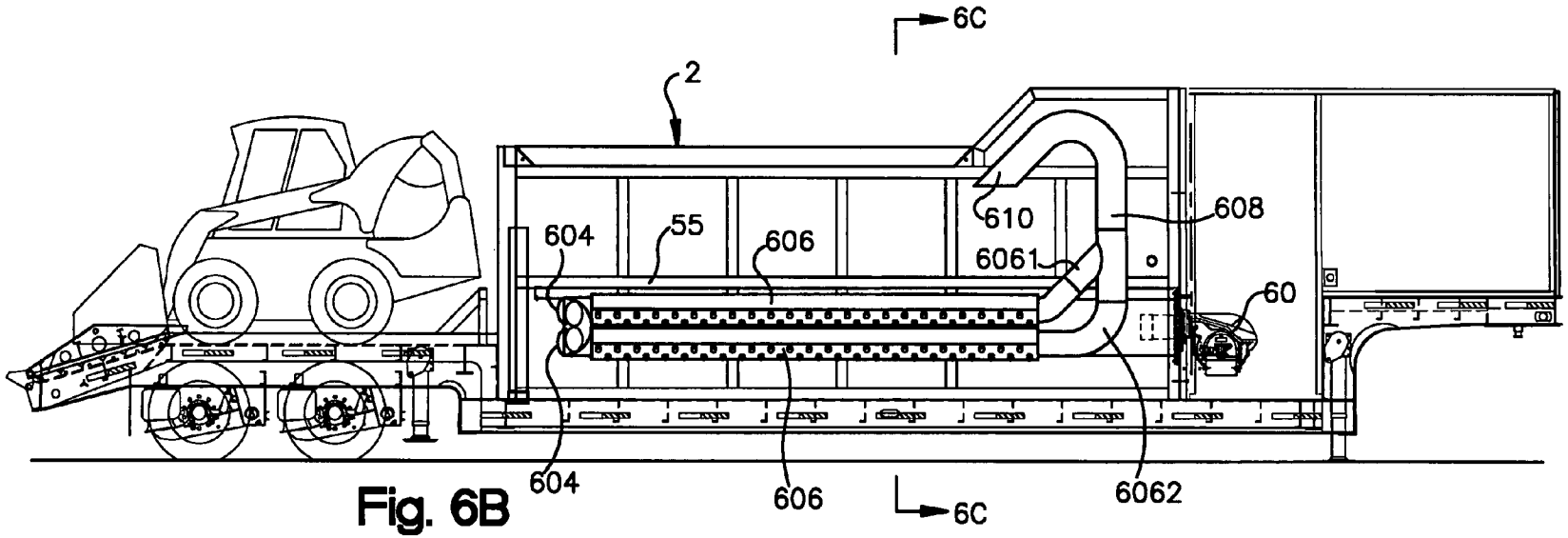
Figure 6C:
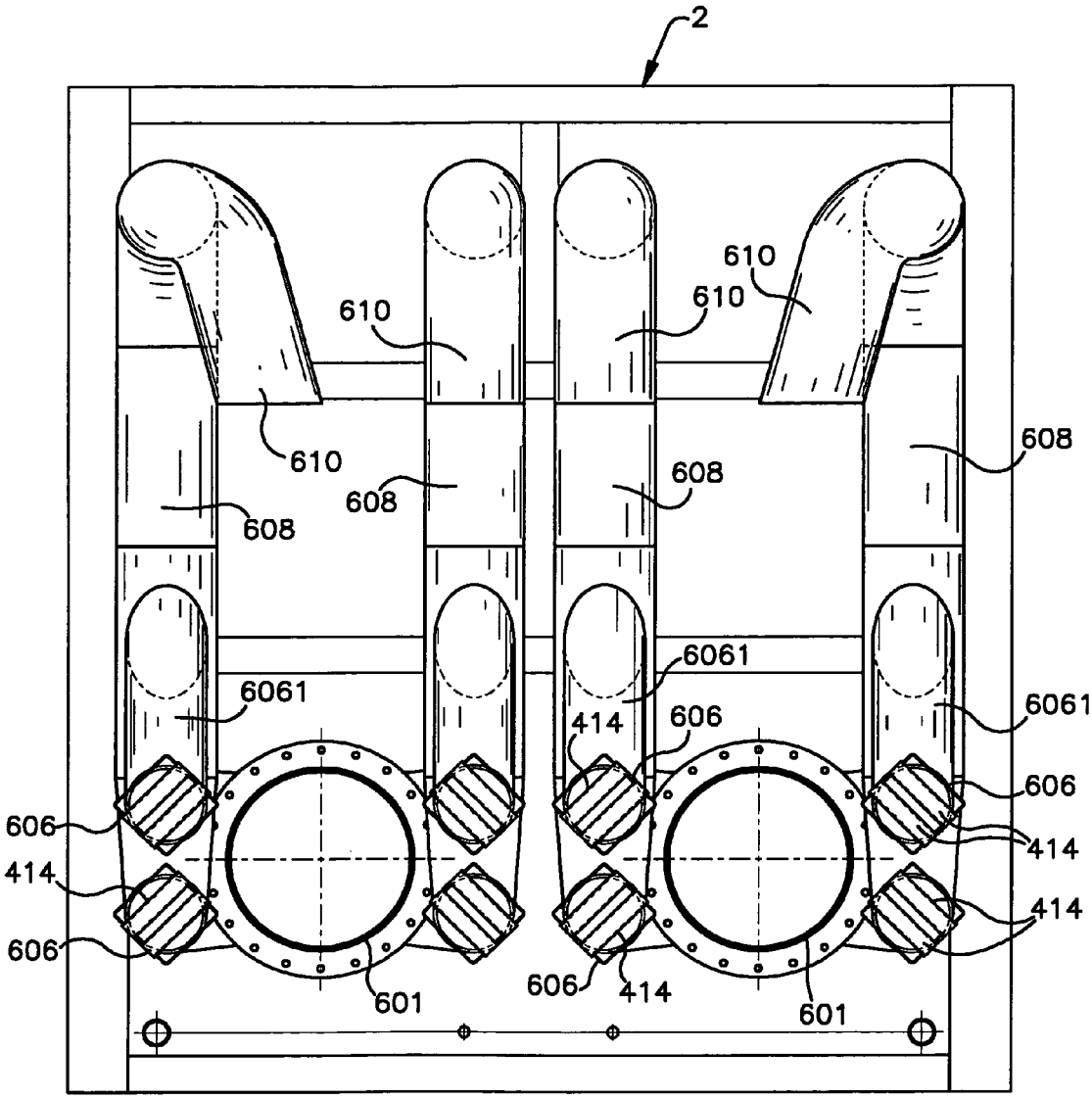

FIGS. 6A, 6B and 6C illustrate an alternate embodiment of a snow melting apparatus of the invention, wherein a hopper 2 is equipped with two heater/blower units 60 located at one wall of the hopper. Each heater/blower unit 60 is operatively coupled to a conduit assembly, indicated generally at 600 located within the hopper 2. Each conduit assembly 600 has a primary intake conduit 601 which runs a substantial length of the hopper 2 in a lower region of the hopper 2. A terminal end of the primary intake conduit 601 is fitted with return conduits 604 which lead to multiple manifold sections 606. In this particular embodiment, as shown in FIG. 6C, there are four manifold sections 606 which are connected to the primary intake conduit 601 by return conduits 604. The manifold sections 606 also run a substantial length of the hopper 2, generally parallel to the primary intake conduit 601, and in this case on both sides of the primary intake conduit 601. This arrangement locates most of the conduit assembly 600 in the lower region of the hopper for compact assembly and packaging underneath the protective grate 55, and increased capacity of the hopper 2. Each of the manifold sections 606 are operatively connected, at ends opposite the return sections 604, to a vertical section 608 which extends from a lower region of the hopper 2 to an upper region of the hopper 2, and which is connected to an exhaust port 610 which is directed downward into to the hopper 2. More particularly, as shown in FIG. 6C, the laterally disposed pairs of manifolds 606 are connected to a single vertical section 608 through connecting sections 6061 and 6062. Each of the manifold sections 606 are equipped with the described heat exchanger passages 414, in this case at complimentary angles relative to vertical, for optimal heat exchange with water surrounding the conduit assembly 600 in the hopper 2. The use of multiple manifold sections 606 with each heater/blower unit 60 further increases the thermal efficiency of the apparatus 1 and enables compact packaging of the conduit assembly within the hopper 2, and compact dimensioning of the hopper 2 which is advantageous for trailer mounting as shown, or for temporary or permanent installation. The cross-sectional and linear volumetric size of the primary intake conduit 601 is preferably larger than that of the other sections or conduits of the conduit assembly 600 to optimize air flow and heat exchange through the conduit assembly.

Although the invention has been described with reference to a particular embodiment and variations thereof, other variations and modifications could be made which are nonetheless within the scope and conceptual principles of the invention, and within the scope and equivalent scope of the claims.

What is claimed as the invention is:

1. A snow melting apparatus comprising:

a hopper for receiving snow or ice to be melted to a liquid or semi-liquid state;

a plurality of heater/blower units coupled to a plurality of conduits which are in thermal communication with the hopper to transfer heated air to snow or ice received in the hopper, each conduit having a primary intake section which is coupled to a heater/blower operative to produce and force heated air through the conduits, and generally located in a lower region of the hopper and a vertical section which extends from a lower region of the hopper to an upper region of the hopper and which is connected to a downdraft section which terminates with an exhaust port in an upper region of the hopper and that is angled towards the center of the hopper to direct heated air downwardly and to an upper region of the hopper.

2. The snow melting apparatus of claim 1, wherein the hopper is generally rectangular with opposed side walls and opposed end walls, and wherein the primary intake section of the conduits extends generally between the opposed end walls.

3. The snow melting apparatus of claim 2, wherein the heater/blower units are located external to the hopper proximate the end walls.

4. The snow melting apparatus of claim 2, wherein the vertical section of the conduits extends from a lower region of the hopper to an upper region of the hopper proximate to one of the end walls of the hopper.

5. The snow melting apparatus of claim 1, wherein each conduit is in thermal communication with a separate dedicated heater/blower unit.

6. The snow melting apparatus of claim 1, wherein the exhaust ports of the conduits are located proximate to an end wall of the hopper.

7. The snow melting apparatus of claim 1 further comprising a grate which overlies at least a section of each conduit and including the vertical section of each conduit.

8. The snow melting apparatus of claim 1 further comprising at least one enclosure proximate to the hopper.

9. The snow melting apparatus of claim 8 further comprising a fuel supply located within the enclosure.

10. The snow melting apparatus of claim 1 further comprising a protective grate which extends substantially over the hopper and over the exhausts of the conduits.

11. The snow melting apparatus of claim 1, wherein the exhaust ports of the conduits are directed downward in the hopper.

12. The snow melting apparatus of claim 1 further comprising a manifold which extends from each conduit, each manifold having a diverter section which extends from the conduit at an acute angle, a generally vertically oriented return and a main section oriented generally parallel to the primary intake section of the conduit from which the manifold extends.

13. The snow melting apparatus of claim 12, wherein the main section of the manifold is located laterally outboard of the corresponding primary intake section.

14. A snow melting apparatus having a hopper for receiving a quantity of snow or ice to be melted, the hopper having a bottom and four side walls, an opening defined by tops of the four side walls and a protective grate at least partially covering the opening of the hopper;

a plurality of heater/blower units, each heater/blower unit operatively connected to a conduit which extends through one of the walls of the hopper, each conduit having a section which runs proximate to the bottom of the hopper, and a section which extends upward from the bottom of the hopper proximate to a side wall of the hopper and terminating in an exhaust which is directed downward into an upper region of the hopper and located under the protective grate.

15. The snow melting apparatus of claim 14, wherein the heater/blower units are located proximate to end walls of the hopper.

16. The snow melting apparatus of claim 14 further comprising a grate which covers the conduit sections which run proximate to the bottom of the hopper.

17. The snow melting apparatus of claim 14, wherein sections of the conduits are of different dimensions.

18. The snow melting apparatus of claim 14 further comprising an integral fuel supply and control system.

19. The snow melting apparatus of claim 14 further comprising a drainage system within the hopper and a drainage control system.

20. A snow melting apparatus comprising:

a hopper having a bottom and four adjoining vertical walls which extend from the bottom to form an internal cavity for receiving snow;

a source of forced heated air external to the walls of the hopper and coupled to a primary intake conduit located in the hopper;

the primary intake conduit coupled to a vertical section which extends to an upper region of the hopper and an exhaust tip which is directed downwardly and into an upper region of the hopper; and a manifold connected to the primary intake conduit and located in the upper region of the hopper.

21. The snow melting apparatus of claim 20, wherein the manifold comprises a diverter section which extends from the primary intake conduit at an acute angle, a return, and a main section which is generally parallel to the primary intake conduit.

22. The snow melting apparatus of claim 20 comprising two or more heather/blower units.

23. The snow melting apparatus of claim 20, wherein the manifold extends from the primary intake conduit at a point spaced from the vertical section.

24. The snow melting apparatus of claim 20, wherein the manifold further comprises one or more heat exchanger passages.

25. The snow melting apparatus of claim 24, wherein the heat exchanger passages are in the form of pipes which extend through a cross-section of the manifold.

26. The snow melting apparatus of claim 20, wherein the primary intake section further comprises one or more heat exchanger passages.

27. The snow melting apparatus of claim 20, wherein the manifold comprises two or more air flow conduits which extend from the primary intake conduit.

28. A snow and ice melting apparatus comprising:

a hopper having an internal cavity for receiving snow and ice;

two or more heater/blower units, each heater/blower unit operatively connected to a conduit assembly located within the hopper;

each conduit assembly having a primary intake section that is connected through a taper to a generally vertical section having a smaller diameter than the primary intake section and connected to an exhaust port, the exhaust port located in an upper region of the hopper and directed downward and toward the upper region of the internal cavity of the hopper, and at least one manifold which extends from the primary intake section and which is located in the hopper.

29. The snow and ice melting apparatus of claim 28, wherein at least one manifold comprises two or more sections of conduit.

30. The snow and ice melting apparatus of claim 28 further comprising one or more heat exchanger passages in the conduit assembly.

31. The snow and ice melting apparatus of claim 28, wherein the manifold further comprises at least, one heat exchanger passage.

32. The snow and ice melting apparatus of claim 28, wherein the manifold is connected to the primary intake section of the conduit assembly at a location between the heater/blower unit and the vertical section of the conduit assembly.

* * * * *